US008636075B2

(12) United States Patent
Franson et al.

(10) Patent No.: US 8,636,075 B2
(45) Date of Patent: Jan. 28, 2014

(54) DRY SPRINKLER ASSEMBLY

(75) Inventors: Scott T. Franson, Hastings, MI (US); Andrew T. Thompson, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 692 days.

(21) Appl. No.: 11/054,476

(22) Filed: Feb. 9, 2005

(65) Prior Publication Data

US 2005/0173562 A1 Aug. 11, 2005

Related U.S. Application Data

(60) Provisional application No. 60/542,901, filed on Feb. 9, 2004.

(51) Int. Cl.
*A62C 37/08* (2006.01)

(52) U.S. Cl.
USPC ..... 169/41; 239/518; 239/541; 239/569; 239/583

(58) Field of Classification Search
USPC ..... 169/37, 38–4, 2, 383–42, 38–42; 239/541, 574, 504, 506, 509, 512, 518, 239/523, 524, 569, 583
See application file for complete search history.

(56) References Cited

U.S. PATENT DOCUMENTS 1,338,469 A 4/1920 Waage et al.
1,903,150 A 3/1933 Tyden
2,155,990 A 4/1939 Hodgman, Jr.
2,180,258 A 11/1939 Rowley
2,732,018 A 1/1956 Grimes
2,768,696 A 10/1956 Sherburne
2,871,953 A 2/1959 Bray
3,007,528 A 11/1961 Gloeckler
3,061,015 A * 10/1962 Cann, Jr. ..... 169/41
3,080,000 A 3/1963 Gloeckler
3,135,331 A 6/1964 Lee
3,584,689 A 6/1971 Willms
4,007,878 A 2/1977 Anderson
4,091,872 A 5/1978 Mountford (Continued)

FOREIGN PATENT DOCUMENTS

WO WO 02/102462 * 12/2002

OTHER PUBLICATIONS

Dry Pendent Sprinklers, Model F960 Designer, 1/2" Orifice; TD552; Grinnell Corporation; (Feb. 1991) (4 pages).

(Continued)

*Primary Examiner* — Christopher Kim
(74) *Attorney, Agent, or Firm* — Harness, Dickey & Pierce, P.L.C.

(57) ABSTRACT

A dry sprinkler assembly includes a housing, a sprinkler head assembly with a sprinkler head and a trigger assembly, and an actuator assembly. The actuator assembly has a sealing sub-assembly for sealing the inlet port of the housing and is operatively coupled to the trigger assembly such that the sealing subassembly releases the sealing of the inlet port in response to the trigger assembly releasing its closure at the outlet opening. The sealing subassembly moves in a linear path substantially parallel with the central longitudinal axis of the housing when releasing the sealing of the inlet port wherein the flow of fire suppressant through the inlet port and into the fluid flow passage is substantially unimpeded.

94 Claims, 9 Drawing Sheets

(56) References Cited

U.S. PATENT DOCUMENTS

| | | | | |
|---|---|---|---|---|
| 4,177,862 | A | 12/1979 | Bray et al. | |
| 4,220,208 | A | 9/1980 | Jackson et al. | |
| 4,228,858 | A | 10/1980 | Sclafani | |
| 4,237,982 | A | 12/1980 | Sclafani | |
| 4,258,795 | A | 3/1981 | Hansen | |
| 4,417,626 | A | 11/1983 | Hansen | |
| 5,188,185 | A | 2/1993 | Mears | |
| 5,228,520 | A | 7/1993 | Gottschalk et al. | |
| 5,775,431 | A | 7/1998 | Ondracek | |
| 5,967,240 | A | 10/1999 | Ondracek | |
| 6,152,236 | A | 11/2000 | Retzloff et al. | |
| 6,367,559 | B1 | 4/2002 | Winebrenner | |
| 6,450,265 | B1 | 9/2002 | Ponte | |
| 6,554,077 | B2 | 4/2003 | Polan | |
| 2002/0050531 | A1 | 5/2002 | Dolan | |
| 2002/0148620 | A1 * | 10/2002 | Polan | 169/38 |
| 2003/0075343 | A1 | 4/2003 | Ballard | |
| 2006/0102362 | A1 | 5/2006 | Polan | |
| 2006/0113093 | A1 | 6/2006 | Silva | |

OTHER PUBLICATIONS

Victaulic, V36, K8.0, "Models V3604 and V3603 Dry Type; Upright—Standard and Quick Response" (Version 40.63); Copyright 2001 Victaulic; (pp. 40.63-1 to 40.63-4) (2001); http://www.victaulic.com/docs/lit/40.63.pdf.

Victaulic V36, K5.6, "Models V3606 and V3605 Dry Type Standard Spray Pendent and Recessed Pendent Standard and Quick Response" (Version 40.60) (pp. 40.60-1 to 40.60-4) (2002); http://www.victaulic.com/docs/lit/40.60.pdf.

Victaulic "Models V3608 and V3607 Standard Spray Pendent and Recessed Pendent Standard and Quick Response" (Version 40.61-2); Copyright 2001 Victaulic; (pp. 40.61-1 to 40-61-4); http://www.victaulic.com/docs/ lit/40.61.pdf.

The Viking Corporation part spec (Part No. 08665) for "Sprinkler Assembly, Dry Type, Glass Bulb, Plain" (2 pages) (Drawings representative of product publicly on sale by The Viking Corporation as early as 2000).

* cited by examiner

DRY SPRINKLER ASSEMBLY

This application claims priority from U.S. provisional application Ser. No. 60/542,901, filed Feb. 9, 2004, entitled DRY SPRINKLER ASSEMBLY, which is incorporated by reference herein in its entirety.

TECHNICAL FIELD AND BACKGROUND OF THE INVENTION

The present invention relates to a sprinkler and, more particularly, to a dry sprinkler that is suitable for use in an area that is exposed to freezing conditions.

SUMMARY OF THE INVENTION

In one form of the invention, a dry sprinkler assembly includes a housing, with an inlet end, an outlet end, a fluid flow passage extending from the inlet end to the outlet end, and a central longitudinal axis along the fluid flow passage. The inlet end is adapted for mounting to a fluid supply pipe and has an inlet port for fluid communication with the fluid supply pipe. A sprinkler head assembly is mounted to the housing, which includes a sprinkler head and a trigger assembly. The sprinkler head is in fluid communication with the fluid flow passage and has an outlet opening, which is substantially closed by the trigger assembly and opened during a fire condition. The sprinkler assembly further includes an actuator assembly. The actuator assembly has a sealing subassembly, which seals the inlet port and is operatively coupled to the trigger assembly such that the sealing subassembly releases the seal of the inlet port in response to the trigger assembly releasing the closure at the outlet opening. In addition, the sealing subassembly moves in a linear path substantially parallel with the central longitudinal axis when releasing the seal of the inlet port wherein the flow of fire suppressant through the inlet port and into the fluid flow passage is substantially unimpeded.

In one aspect, the housing comprises a tubular member, such a round tubular member.

In another aspect, the actuator assembly includes a spring to urge the actuator assembly into contact with the thermally responsive trigger assembly.

According to yet other aspects, the sealing subassembly comprises a spring plate and a spring plate support, which supports the spring plate. The spring plate seals the inlet port. Furthermore, the spring plate and the spring plate support preferably comprise a unitary assembly.

In yet other aspects, the actuator assembly includes the fluid flow passage extending therethrough. For example, the actuator assembly may include a plurality of collinear members, with each of the members having a passage, which together form the fluid flow passage. One of the members may comprise a tubular member, with the spring support assembly adjacent to the tubular member. Preferably, the spring support assembly is coupled to the tubular member.

In a further aspect, the spring support assembly comprises a base, a plurality of arms, and a spring plate coupled to the base. The arms are coupled to the tubular member. Another of the members may comprise a conical section, with the tubular member adjacent to and aligned with the conical section. In addition, the sprinkler assembly may include a spring, which urges the tubular member into contact with the other member. For example, the spring is preferably mounted to the tubular member.

In a further aspect, the other member comprises a second tubular member adjacent the other member, which contacts the trigger assembly.

According to another form of the invention, a dry sprinkler assembly includes a housing with an inlet port for fluid communication with a fluid supply pipe, a sprinkler head assembly, with a sprinkler head and a trigger assembly, and an actuator assembly, which has a fluid flow passage extending from the inlet end of the housing to the outlet end of the housing. The actuator assembly seals the inlet port and is operatively coupled to the trigger assembly such that the actuator assembly releases the sealing of the inlet port in response to the trigger assembly unseating from the outlet opening. Further, the actuator assembly moves in a linear path substantially parallel with the central longitudinal axis of the sprinkler assembly when releasing the seal of the inlet port wherein the flow of fire suppressant through the inlet port and into the fluid flow passage is substantially unimpeded.

In other aspects, the actuator comprises a sealing subassembly, which includes a spring plate, which releasably seals the inlet port. The sealing subassembly further includes a spring plate support, which supports the spring plate. Preferably, the spring plate and the spring plate support comprise a unitary assembly.

In further aspects, the spring plate support comprises a base and a plurality of arms, which define therebetween a plurality of passages, which form a portion of the fluid flow passage.

In addition, the actuator assembly comprises a plurality of collinear members, with each of the members having a passage, which are in communication and form another portion of the fluid flow passage.

Accordingly, the present invention provides a sprinkler assembly that is suitable for use in an area that is exposed to freezing conditions and further that incorporates an actuator that reduces the impedance to the flow of fluid through the sprinkler assembly over conventional dry sprinklers so that the sprinkler assembly exhibits a stable K-factor.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
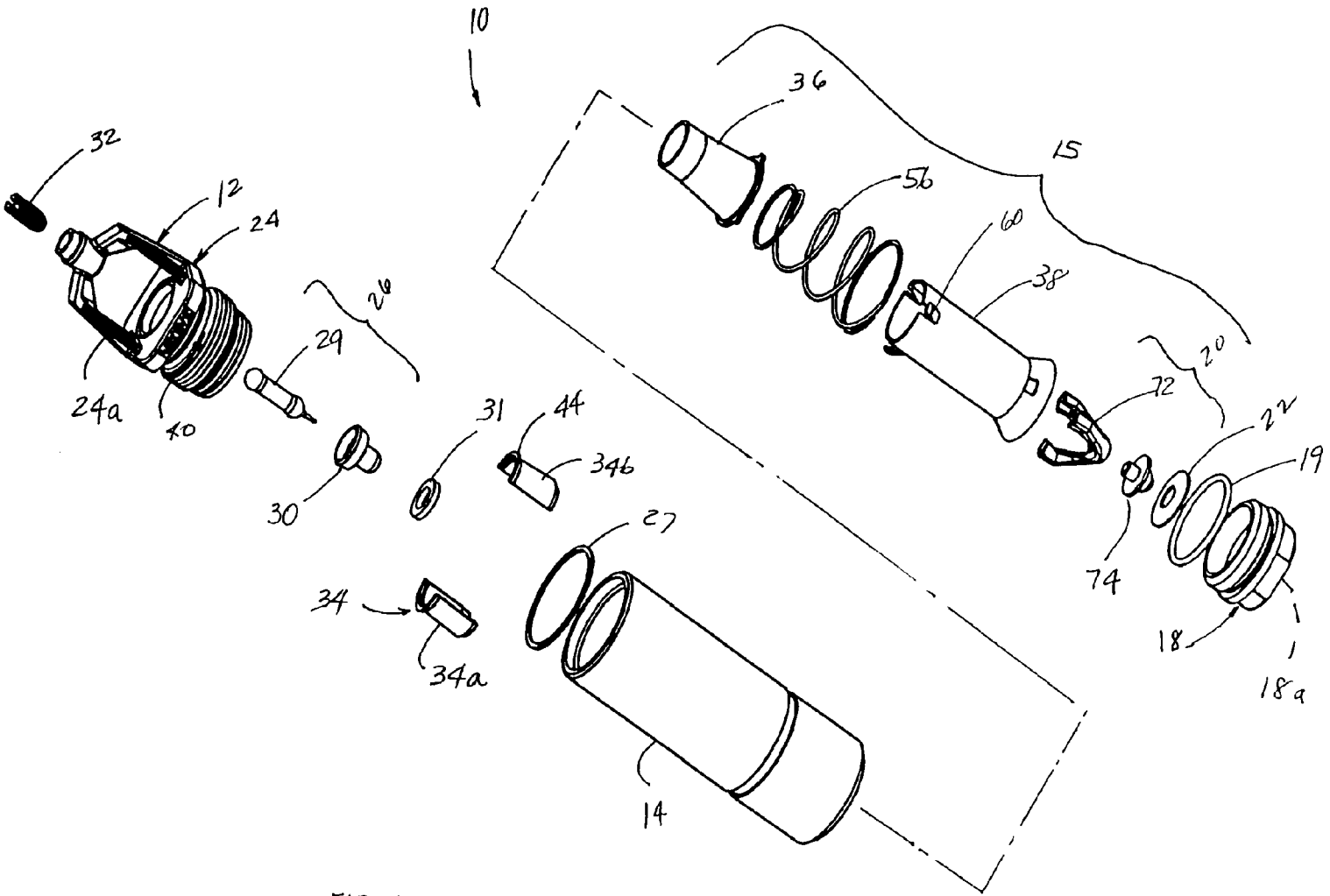
FIG. 1 is an exploded perspective view of a dry sprinkler assembly of the present invention.
Figure 2:
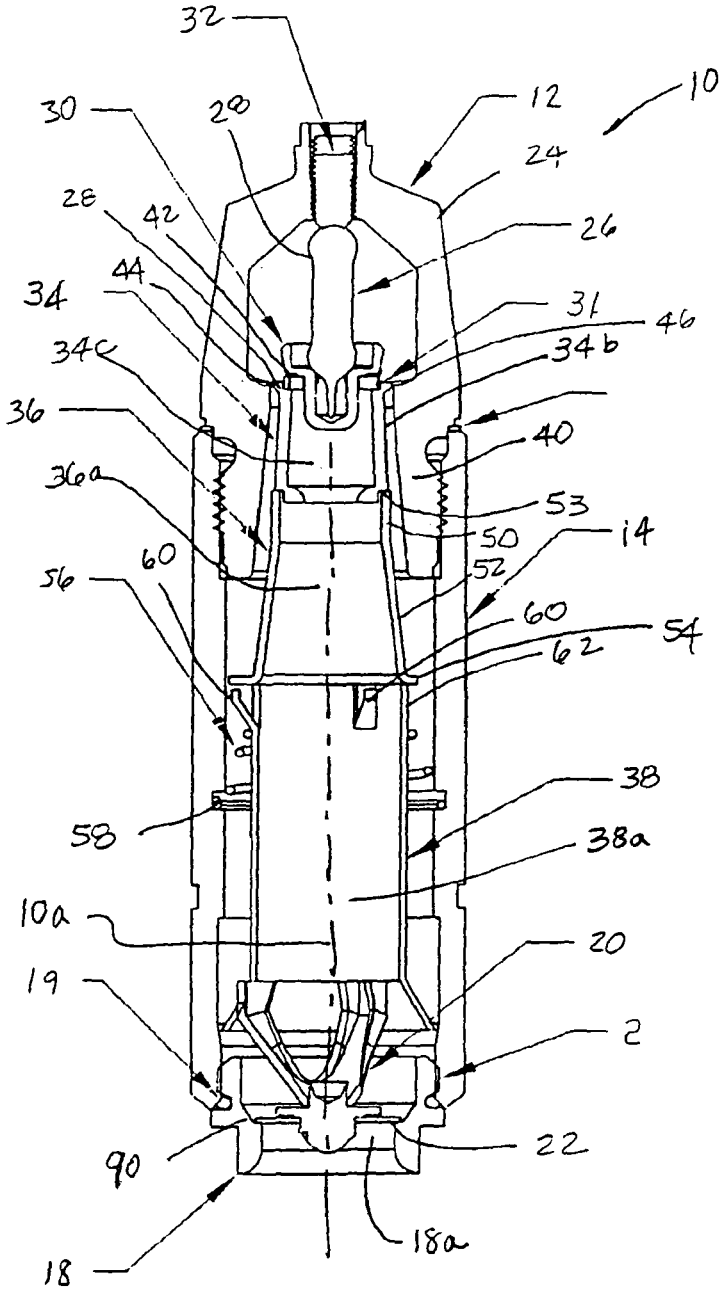
FIG. 2 is a cross-section view of the sprinkler assembly of FIG. 1.
Figure 5:
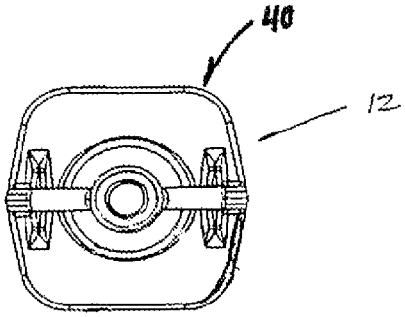
FIG. 5 is a top plan view of the sprinkler head of FIG. 3.
Figure 3:
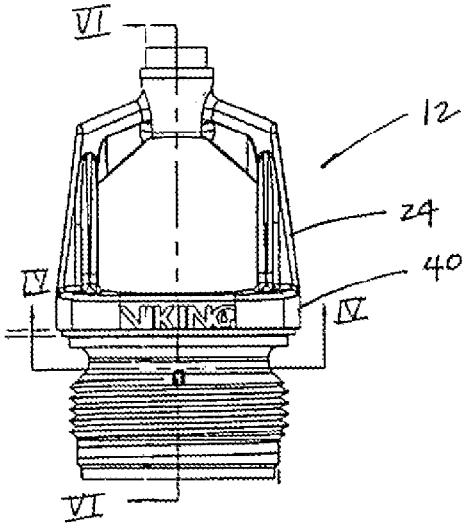
FIG. 3 is an enlarged elevation view of the sprinkler head of the sprinkler assembly of FIG. 1.
Figure 6:
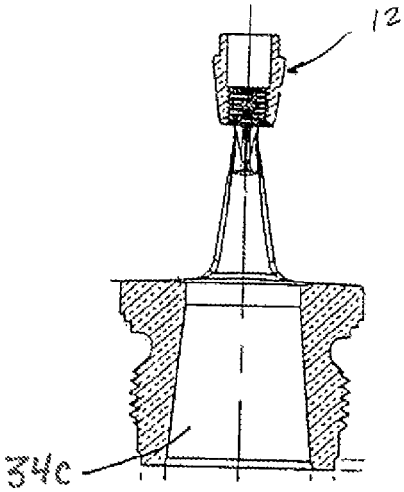
FIG. 6 is a cross section view taken along line VI-VI of FIG. 3.
Figure 4:
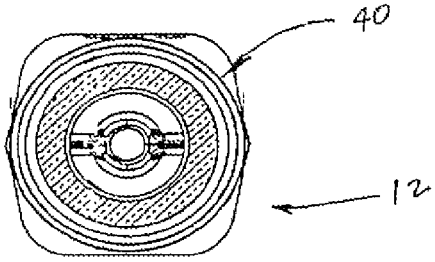
FIG. 4 is a cross-section view taken along line IV-IV of FIG. 3.
Figure 9:
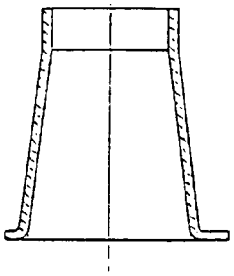
FIG. 9 is a cross-section view taken along line IX-IX of FIG. 7.
Figure 8:
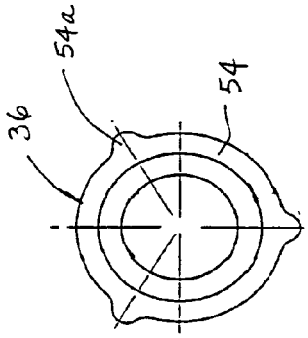
FIG. 8 is a bottom plan view of the orifice member of FIG. 7.
Figure 7:
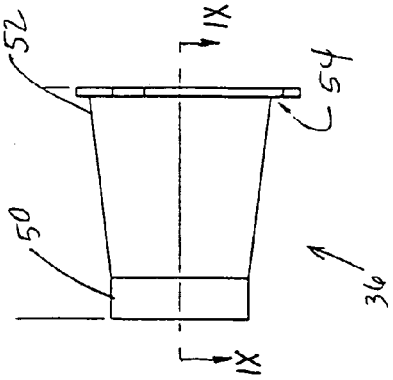
FIG. 7 is an enlarged side view of the orifice member of the sprinkler assembly of FIG. 1.
Figure 12:
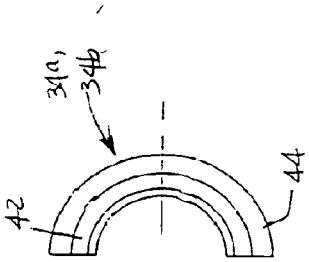
FIG. 12 is a top plan view of the seat member of FIG. 10.
Figure 11:
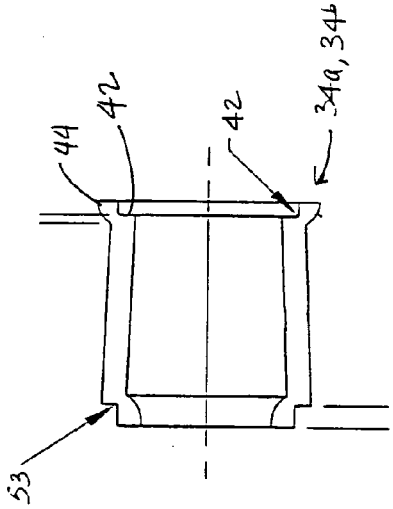
FIG. 11 is a side elevation view of the seat member of FIG. 10.
Figure 10:
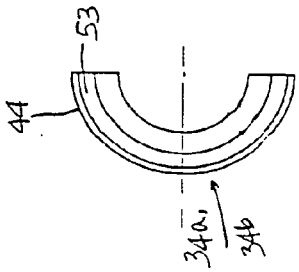
FIG. 10 is a bottom plan view of one of the seat members of the sprinkler assembly of FIG. 1.
Figure 16:
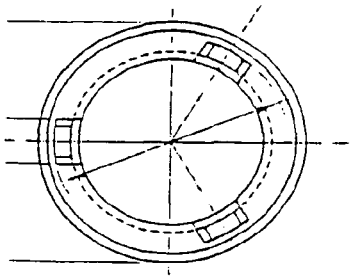
FIG. 16 is an opposed end view of the tube of FIG. 14.
Figure 15:
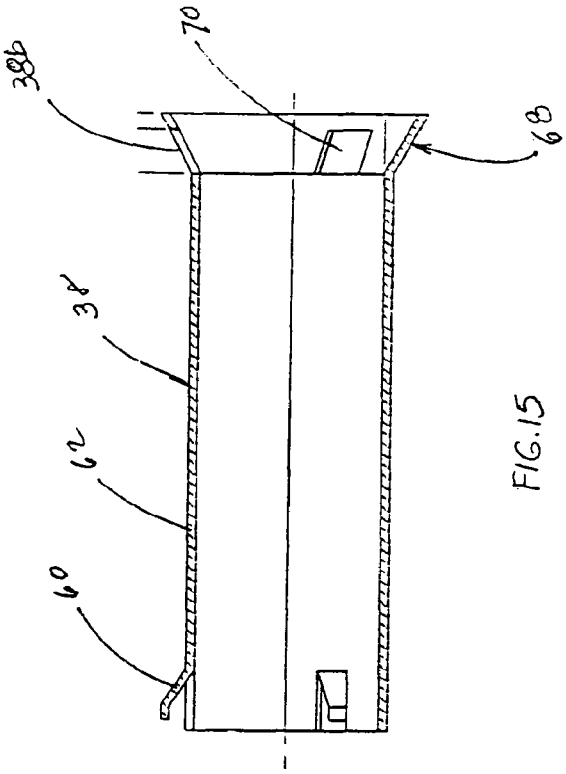
FIG. 15 is a cross-section view of the tube of FIG. 14.
Figure 13:
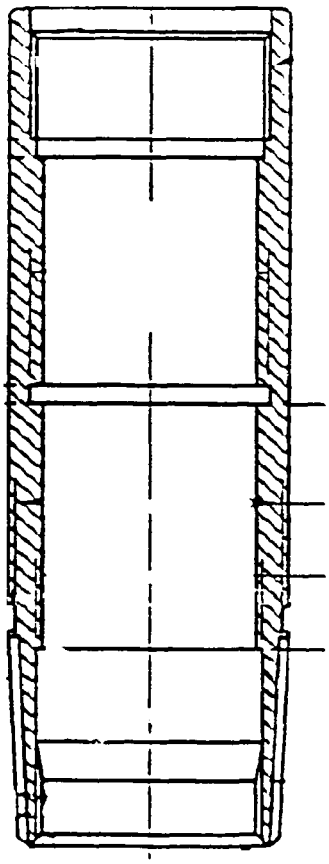
FIG. 13 is an enlarged cross-section view of a tube of the sprinkler assembly of FIG. 1.
Figure 14:
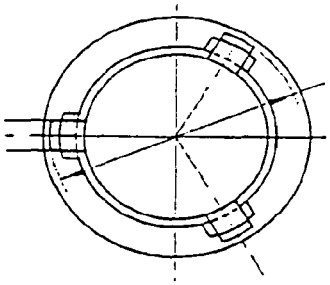
FIG. 14 is an end view of the tube of a second sprinkler assembly of FIG. 1.

Referring to FIGS. 1 and 2, the numeral 10 generally designates a dry sprinkler assembly of the present invention. As will be more fully described below, dry sprinkler assembly 10 incorporates an actuator assembly 15 that controls the flow of fire suppressant into the sprinkler assembly from a fire suppressant supply pipe (not shown) while reducing the drawbacks associated with prior art dry sprinklers in which the internal actuating mechanisms may often interfere with and impede the flow of water suppressant to the sprinkler head and maintaining the K-factor of the sprinkler assembly stable. The "K" factor of a sprinkler is the discharge coefficient of the sprinkler head assembly, which equals the flow of fluid, such as water, in gallons per minute through the passageway of the sprinkler head body divided by the square root of the pressure of fluid fed into the sprinkler head body in pounds per square inch gauge.

Dry sprinkler assembly 10 includes a sprinkler head assembly 12, a housing 14, and an inlet member 18, which threads into the end of housing 14. Housing 14 also includes threads on its outer surface for threading into the supply pipe, which couples assembly 10 to the fire suppression supply pipe. Housing 14 comprises a tubular member, preferably a round metal tubular member, and includes an inlet end 14*a* and an outlet end 14*b*. Inlet member 18 is mounted to inlet end 14*a* of housing 14 to provide a seat 90, which then forms the seal with the supply pipe, as will be more fully described below. Inlet member 18 comprises a metal annular member with a threaded end for securing inlet member 18 into inlet end 14*a* of housing 14 and an annular base, which inserts into the fire suppressant supply pipe. The threaded end of inlet member 18 is preferably secured in the inlet end 14*a* of housing 14 with an adhesive, such as an epoxy. Furthermore, an o-ring seal 19 is preferably positioned between inlet member 18 and housing 14.

Positioned in housing 14 is actuator assembly 15, which controls the flow of fire suppressant into housing 14 and through sprinkler head assembly 12. Actuator assembly 15 is mounted to outlet end 14*b* of housing 14, as will be more fully described below. Sprinkler head assembly 12 includes a sprinkler head 24 and a trigger assembly 26. Sprinkler head 24, which is preferably formed from brass, threads into the outlet end of housing 14 and is preferably secured therein with an adhesive, such as an epoxy. Furthermore, a spacer 27, such as a metal, preferably stainless steel, spacer, is positioned between sprinkler head 24 and housing 14.

Trigger assembly 26 comprises a heat sensitive trigger assembly that opens the outlet opening 28 of sprinkler head 24 in response to detecting a temperature associated with a fire condition. Though it should be understood that trigger assembly 26 may comprise another type of trigger assembly. Furthermore, trigger assembly 26 is coupled to actuator assembly 15 in a manner such that when trigger assembly 26 is actuated—or in other words exposed to a temperature associated with a fire condition—actuator assembly 15 opens the inlet opening 18*a* of inlet member 18 to allow water to flow into and from sprinkler assembly 10.

In the illustrated embodiment, trigger assembly 26 includes a glass bulb 29 and a holder 30. Holder 30 is also preferably metal, such as leaded bronze. Glass bulb 29 is a conventional thermally sensitive bulb that breaks upon exposure to a temperature associated with a fire. Bulb 29 is supported between frame 24*a* of sprinkler head 24 and holder 30, which is positioned in outlet opening 28, by a compression screw 32, which preferably comprises a threaded brass rod. Screw 32 urges bulb 29 into holder 30, and, hence, urges holder 30 in opening 28. Positioned between holder 30 and outlet opening 28 is a washer 31, such as stainless steel washer, whose thickness can be varied to accommodate the various tolerances of the component parts of sprinkler assembly 10.

As best seen in FIG. 2, actuator assembly 15 supports washer 31 in base 40 of sprinkler head 24 and extends between washer 31 and inlet member 18 to seal inlet opening 18*a* of inlet member 18 so that housing 14 is free of fire suppressant fluid, and instead is filled with air, until such time that the sprinkler assembly is exposed to a temperature associated with a fire condition. Furthermore, actuator assembly 15 and its various members, described below, move in a generally linear path along or parallel to the central longitudinal axis 10*a* (FIG. 2) of sprinkler assembly 10 away from inlet opening 18*a* when trigger assembly 26 is actuated so that inlet opening 18*a* is no longer sealed and, further, so that the flow of fire suppressant can flow into sprinkler assembly 10 and out from sprinkler head assembly 12 substantially unimpeded by the actuator assembly to thereby stabilize the K-factor of the sprinkler assembly.

As best seen in FIG. 2, actuator assembly 15 includes a plurality of members that are generally aligned along axis 10*a* between washer 31 and inlet member 18 and, further, which define a fluid flow passage 15*a* for the fire protection fluid through housing 14. As best seen in FIGS. 1 and 2, actuator assembly 15 includes a seat 34, which supports washer 31, an orifice member 36, and an inner tubular member 38. Seat 34 is formed from two half-cylindrical members 34*a* and 34*b*, preferably metal members, such as copper members, which are positioned in the base 40 of sprinkler head 24. Members 34*a* and 34*b* are juxtaposed with their upper ends positioned in outlet opening 28 and positioned to support washer 31 (FIG. 2) in opening 28.

The upper end of orifice member 36 is similarly positioned in base 40 of sprinkler head 24 and, further, abuts the lower ends of members 34*a* and 34*b*. The lower ends of members 34*a* and 34*b* have a groove or shoulder 53 formed or provided therein to form a seat for the upper end of orifice member 36. In this manner, orifice member 36 and seat 34 are laterally coupled. Orifice member 36 similarly comprises a metal member, such as a copper member.

Tubular member 38, which is positioned in member 14 and abuts a lower end of orifice member 36, is engaged by a spring support assembly 20. Tubular member 38 preferably comprises a round metal tubular member with a flared or tapered end, described below. As previously noted, seat 34, orifice member 36, and tubular member 38 are generally collinear and, further, are stacked between spring support assembly 20 and holder 30 with each having a transverse passage 34*c*, 36*a*, and 38*a*, respectively, to form fluid flow passageway 15*a* from inlet member 18 to sprinkler head 24 for fire suppressant fluid to flow from the fire protection system through tubular member 14 and through sprinkler head 24 to be dispersed by deflector 16.

As previously noted, seat 34 is formed from two members and, in the illustrated embodiment, is formed from two half-cylindrical members 34*a* and 34*b*, which are substantially mirror images of each other and are arranged in a juxtaposed position in base 40 of sprinkler head 24. When placed in their juxtaposed or adjacent relationship, such as shown in FIG. 2, the upper ends of members 34*a* and 34*b* form an upper annular recess or seat 42 for washer 31 and an annular rim 44. When positioned in base 40, the outer perimeter of annular rim 44 rests against the annular seat 46 formed in base 40 of sprinkler head 24. Members 34*a* and 34*b* are held in position against annular seat 46 by washer 31 and trigger assembly 26. In this manner, seat 34 together with trigger assembly 26, and washer 31 substantially close outlet opening 28.

As previously noted, mounted at the opposed ends of members 34*a* and 34*b* is orifice member 36, which includes a first right-cylindrical section 50 and a conical section 52. Section 50 is seated in a lower annular recess or seat 53 formed on lower ends of members 34*a* and 34*b*. Lower end of conical section 52 includes a flange 54 against which tubular member 38 is seated.

Tubular member 38 is urged toward orifice member 36 by a spring 56, such as a coil spring, such as a stainless steel coil spring, which extends around tubular member 38 and which is seated on one end in an annular groove 58 formed in the inner surface of tubular member 14 and seated on its opposed end against a plurality of outwardly extending tabs 60 formed in cylindrical wall 62 of tubular member 38. Tabs 60 are aligned with tabs 54*a* of flange 54, so that when tube 38 is urged toward orifice member 36, tabs 60 contact tabs 54*a* for added stability.

As previously noted, members 34, 36, and 38 are coaxial and provide a fluid flow passageway for fire suppressant fluid to flow from inlet member 18 to sprinkler head 24. Spring support assembly 20 is mounted to a lower end of tubular member 38 and is mounted to tubular member 38 from an opposed end from orifice member 36 so that spring support assembly 20 positions a spring seal 22 against and seals the inlet opening 18*a* of inlet 18. Spring plate 22 preferably comprises a metal spring plate formed from a nickel alloy and, further, is coated with a Teflon tape at least on its lower side, and preferably on both its sides, to reduce friction between plate 22 and inlet member 18. Lower end 38*b* of tubular member 38 includes an outwardly flared or conical portion 68 that includes a plurality of openings 70 for engaging or being engaged by spring support assembly 20, as will be described below.

Figure 17:
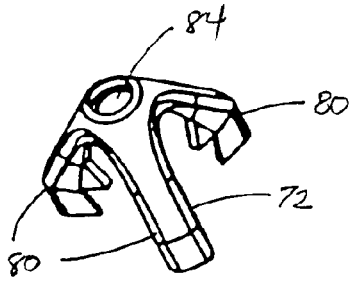
FIG. 17 is an enlarged perspective view of a support of the sprinkler assembly of FIG. 1.
Figure 18:
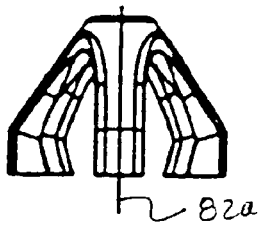
FIG. 18 is a side view of the support of FIG. 17.
Figure 19:
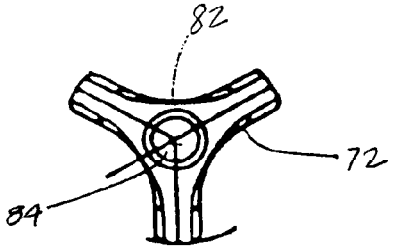
FIG. 19 is a top plan view of the support of FIG. 17.
Figure 20:
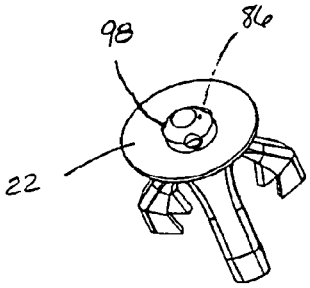
FIG. 20 is a perspective view of the support of FIG. 17 with a spring base and spring mounted to the support.
Figure 21:
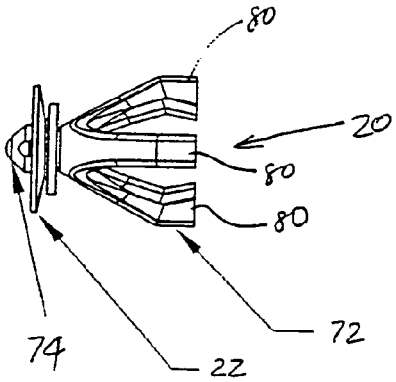
FIG. 21 is a side elevation view of the spring support assembly of FIG. 20.
Figure 22:
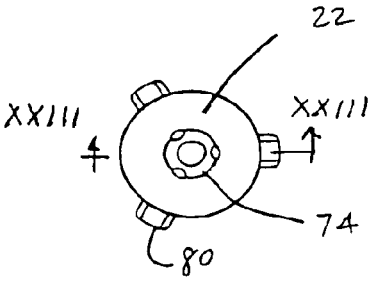
FIG. 22 is a top plan view of the spring support assembly of FIG. 20.

Referring to FIGS. 17-26, spring support assembly 20 includes a support base 72 (FIG. 17), a spring base 74 (FIGS. 24-26), and spring plate 22. As best seen in FIGS. 17 and 19, support base 72 includes a plurality of downwardly depending mounting arms 80 (as viewed in FIG. 17), which project radially outward from a central body 82 with a transverse opening 84. Arms 80 have an arcuate cross-section and extend from body 82 at an acute angle to form a plurality of passageways through which the fire suppressant fluid flows into inner tubular member 38. The lower ends of arms 80 have an enlarged C-shaped cross-section, which insert into openings 70 of tubular member 38, and are angled with respect to the upper portions of arms 80 so that their outer surfaces are generally parallel to the central longitudinal 82*a* of body 82. In this manner, arms 80 couple spring support assembly 20 to tubular member 38.

Figure 24:
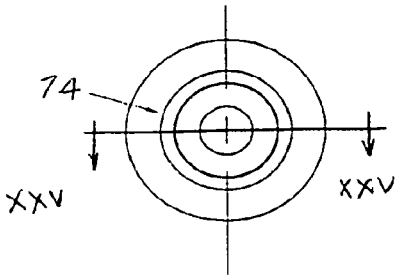
FIG. 24 is a top plan view of the spring base of FIGS. 20-23.
Figure 25:
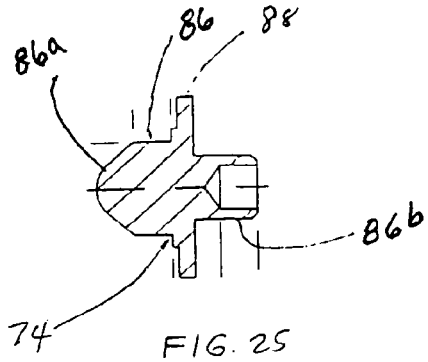
FIG. 25 is a cross-section view taken along line XXV-XXV of FIG. 24.
Figure 26:
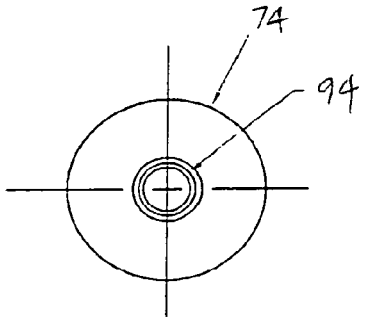
FIG. 26 is a bottom plan view of the spring base of FIG. 24.
Figure 27:
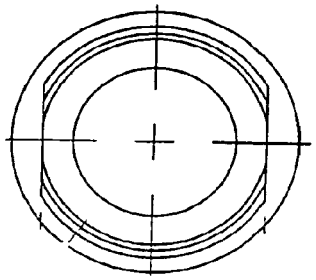
FIG. 27 is a bottom plan view of an inlet member of the spring assembly of FIG. 1.

Mounted in transverse opening 84 is spring base 74. Base 74 is preferably coupled to support base 72 by, for example, staking. As best seen in FIGS. 24-26, spring base 74 includes a central body 86, with an upwardly projecting rounded boss 86*a* and a rearwardly projecting collar 86*b*, and an annular flange 88 against which spring plate 22 is positioned and against which spring plate 22 is urged when spring support assembly 20 is mounted in sprinkler assembly 10. When spring support assembly 20 is seated in tubular member 38, the upper ends (as viewed in FIG. 2) of arms 80 extend into openings 70 of tubular member 38 to thereby couple spring support assembly 20 to tubular member 38. Bases 72 and 74 are both preferably metal bases, such as bronze bases.

Figure 23:
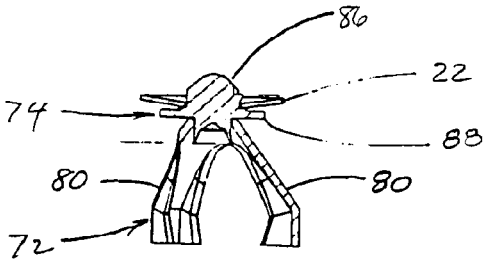
FIG. 23 is a cross-section view taken along line XXIII-XXIII of FIG. 22.
Figure 28:
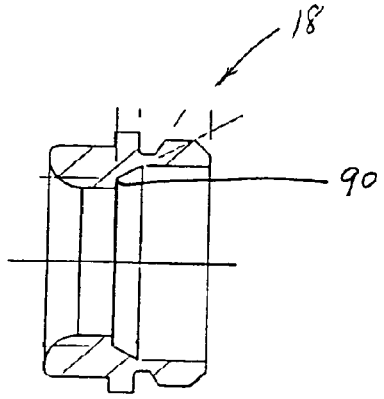
FIG. 28 is a cross-section view of the inlet member of FIG. 27.
Figure 30:
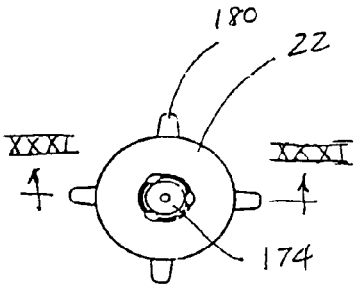
FIG. 30 is a top plan view of the spring support assembly of FIG. 29.
Figure 29:
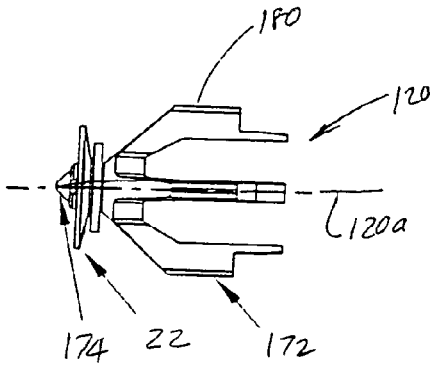
FIG. 29 is a side elevation view of another embodiment of the support spring support assembly of the present invention.
Figure 31:
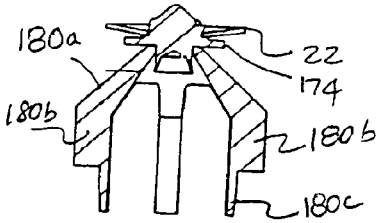
FIG. 31 is a cross-section view taken along line XXXI-XXXI of FIG. 30.
Figure 32:
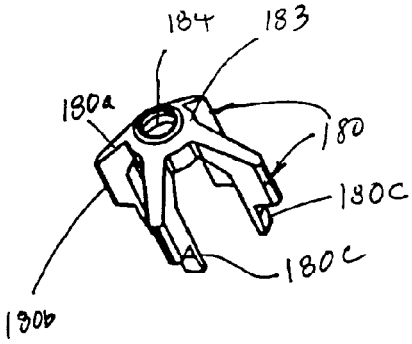
FIG. 32 is a perspective view of the support of the spring support assembly of FIGS. 29-31.
Figure 33:
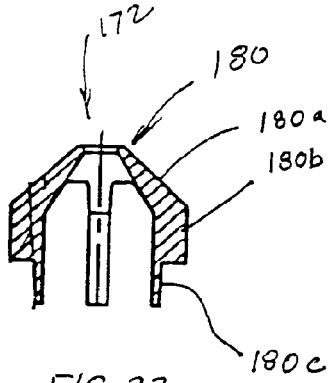
FIG. 33 is a cross-section view of the support of FIG. 32.

As best understood from FIGS. 2 and 23, prior to assembly, spring plate 22 assumes a generally concave configuration and, when assembled, a generally planar orientation when spring plate 22 is urged against annular seat 90 (FIG. 28) provided or formed in inlet member 18. Thus, as would be understood, when the downward pressure applied against spring plate 22 is released, spring plate 22 will assume its concave configuration as shown in FIG. 23 to thereby urge support 72 and tubular member 38 upwardly toward sprinkler head 24, as will be more fully described below.

Referring again to FIGS. 23 and 25, spring base 74 extends into opening 84 of support base 72 and, further, is secured to support by riveting. In addition, spring plate 22 is similarly coupled to spring base 74 by, for example, staking. In this manner, spring support assembly 20 comprises a unitary assembly in which each of the components, namely the support base 72, spring base 74, and spring plate 22 are coupled and, therefore, reduce, if not eliminate, the possibility of the components interfering with the flow of water suppressant to the sprinkler head when the sprinkler head 24 is opened in response to detecting a temperature associated with a fire condition. Furthermore, because each of the actuator assembly components, including the spring support assembly, are interconnected, the actuator assembly moves in a generally linear path along or substantially parallel to the central axis 10*a* of sprinkler assembly 10 when the downward pressure from trigger assembly 26 is released with spring seal 22 being lifted off inlet opening so that fluid flows into inlet member 18 and between arms 80 into passage 15*a*. Thus, actuator assembly 15 reduces the interference with the flow of the fire suppressant fluid through the sprinkler assembly to thereby stabilize the K-factor of sprinkler assembly 10.

In operation, when sprinkler assembly 10 is subject to a temperature associated with a fire, trigger assembly 26 will release holder 30 and, therefore, release washer 48 from seat 34. Once seat 34 is no longer urged downward (as viewed in FIG. 2), spring 56, acting upon tubular member 38, will urge tubular member 38 upward and orifice member 36 upward to urge seat 34 outwardly through outlet opening 28. Upon the upward movement of tubular member 38, the force applied to compress spring plate 22 will be released, thus spring plate 22 will assume its concave configuration to also urge tubular member 38 upward (as viewed in FIG. 2). Spring plate 22 will be unseated from annular seat 90 under the pressure of the fire extinguishing fluid from the fire suppressant pipe, which will then allow the fluid from the fire suppression pipe to enter into sprinkler assembly 10 and pass between the respective arms 80 of spring support assembly 20 and, further, to enter passageways 38*a*, 36*a*, and 34*c* of members 38, 36, and 34, respectively, and, further, to exit outlet opening 28 of sprinkler head 24.

Referring to FIGS. 29-33, the numeral 120 designates another embodiment of the spring support assembly of the present invention. Spring support assembly 120 is of similar construction to spring support assembly 20 and includes a support base 172, a spring base 174, and plate spring 22, similar to the previous embodiment. In the illustrated embodiment, support base 172 includes four support arms 180 which are generally equally spaced around a central axis 120*a* of spring support assembly 120. In addition, each arm 180 is formed from solid flange and includes an upper portion 180*a* with a tapered cross-section that extends from central portion 183 outwardly and downwardly, a medial portion 180*b* that extends downwardly from upper portion 180*a* with a generally uniform cross-section, and a lower portion 180*c* that has a reduced thickness to form tabs for inserting into the respective openings of tubular member 38, such that medial portions 180*b* form seats or stops for tubular member 38.

Figure 34:
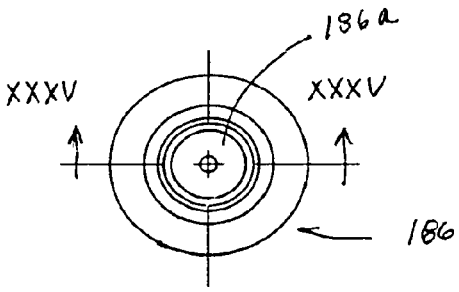
FIG. 34 is an enlarged top plan view of the spring base of the spring support assembly of FIGS. 29-31.
Figure 35:
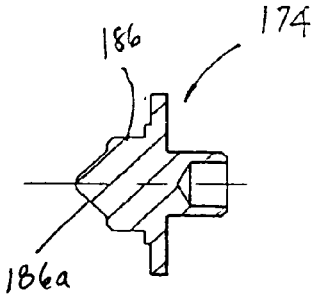
FIG. 35 is a cross-section view taken along line XXXV-XXXV of FIG. 34.

Referring to FIGS. 34-35, spring base 174 is of similar construction to spring base 74 but includes a conical shaped boss 186*a*. Similar to the previous embodiment, spring base 174 is coupled to base 172 and spring plate 22 is secured to base 174, for example, by staking.

Figure 36:
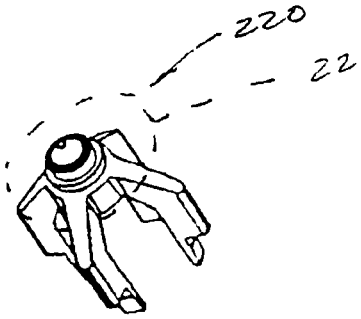
FIG. 36 is a perspective view of yet another embodiment of the spring support assembly of the present invention.
Figure 37:
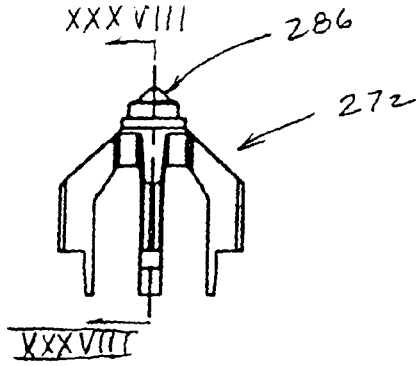
FIG. 37 is a side elevation view of the spring support assembly of FIG. 36.
Figure 38:
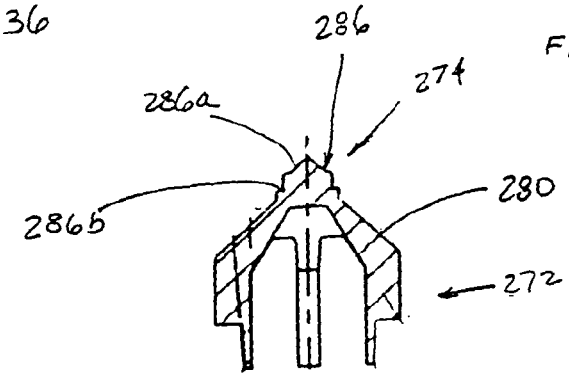
FIG. 38 is a cross-section view taken along line XXXVIII-XXXVIII of FIG. 37.

Referring to FIGS. 36-38, the numeral 220 designates yet another embodiment of the spring support assembly of the present invention, which includes spring plate 22 and a spring support base 272 that incorporates the functions and features of the spring bases and support bases of the previous embodiments into a monolithic, unitary part, which facilitates assembly of the sprinkler assembly.

In the illustrated embodiment, spring support base 272 incorporates four mounting arms similar to the previous embodiment; however, it should be understood that that spring support base 272 may include three arms similar to assembly 20.

As best understood from FIG. 38, spring support base 272 includes a central portion 283 and a plurality of arms 280 that project from central portion 283. Central portion 283 includes an upwardly projecting boss 286 with a conical portion 286*a* and an annular rim 286*b*, which provides a mounting surface for spring plate 22, which is coupled to spring support base 272 by staking, similar to the previous embodiments.

As should be understood from the foregoing, the dry sprinkler assembly of the present invention provides an improved assembly with a more stable configuration where its component parts are configured to reduce the likelihood of fluid flow blockage through the sprinkler assembly when the sprinkler assembly has been activated to open.

While several forms of the invention have been shown and described, other forms will now be apparent to those skilled in the art. For example, though the tubular members are illustrated with round tubular cross-sections, the tubular members may assume other tubular configurations. In addition, the number of tabs provide on tubular member 38 may be increased. Furthermore, other trigger assemblies may be used including a trigger assembly that incorporates a fusible link in lieu of a bulb. Therefore, it will be understood that the embodiments shown in the drawings and described above are merely for illustrative purposes, and are not intended to limit the scope of the invention, which is defined by the claims that follow as interpreted under the principles of patent law, including the doctrine of equivalents.

We claim:

1. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port; and wherein said sealing subassembly comprises a concave spring plate having a concave surface facing said inlet port and a spring plate support, said spring plate support being fixedly attached to and compressively loading said spring plate axially against a surface of said inlet end surrounding said inlet port so as to flatten said spring plate toward a generally planar orientation when assembled, said spring plate support and said spring plate being fixed for movement along said central longitudinal axis so as to be disposed along said central longitudinal axis both prior to and after said trigger assembly releases, so that water flowing through said housing flows around said spring plate fixed along said central longitudinal axis.

2. The dry sprinkler assembly according to claim 1, wherein said housing comprises a tubular member.

3. The dry sprinkler assembly according to claim 2, wherein said tubular member has a round cross-section.

4. The dry sprinkler assembly according to claim 1, wherein said actuator assembly includes a spring to urge said actuator assembly into contact with said trigger assembly.

5. The dry sprinkler assembly according to claim 1, wherein said spring plate and said spring plate support comprise a unitary assembly.

6. The dry sprinkler assembly according to claim 1, wherein said actuator assembly includes said flow passage extending therethrough.

7. The dry sprinkler assembly according to claim 1, wherein said trigger assembly comprises a thermal responsive trigger assembly.

8. The dry pipe sprinkler assembly according to claim 1 wherein said spring plate support includes a projecting boss extending upstream of said spring plate.

9. The dry pipe sprinkler assembly according to claim 1, wherein said projecting boss includes a central tip disposed generally on said central axis and a tapered portion extending downstream from said central tip.

10. The dry pipe sprinkler assembly according to claim 9, wherein said tapered portion is conical.

11. The dry pipe sprinkler assembly according to claim 9, wherein said actuator assembly includes said flow passage extending therethrough.

12. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port defining a place of ingress of water into said housing, a central axis of said inlet port being axially aligned with said central longitudinal axis of said housing for fluid communication with the fluid supply pipe;

a sprinkler head assembly having a sprinkler head and a trigger assembly, said sprinkler head having a threaded base and a frame extending from said threaded base, said sprinkler head being threadedly connected to said housing and in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port; and wherein said actuator assembly comprises a plurality of collinear tubular members, each of said tubular members having a passage, said passages forming said fluid flow passage, a first of said tubular members comprises a first outwardly flared conical section extending radially outward from a cylindrical body section of said first of said tubular members, a second of said tubular members being adjacent to and aligned with said first of said tubular members and including a diameter reducing conical section disposed adjacent to and aligned with said cylindrical body section of said first of said tubular members, wherein said sealing subassembly is fixed to said first of said tubular members so as to be disposed along said central longitudinal axis of said housing both prior to and after said trigger assembly releases.

13. The dry pipe sprinkler assembly according to claim 12, wherein said sealing subassembly includes a spring plate and a spring plate support supporting said spring plate and having a projecting boss extending upstream of said spring plate.

14. The dry pipe sprinkler assembly according to claim 13, wherein said projecting boss includes a central tip disposed generally on said central axis and a tapered portion extending downstream from said central tip.

15. The dry pipe sprinkler assembly according to claim 14, wherein said tapered portion is conical.

16. The dry pipe sprinkler assembly according to claim 13, wherein said actuator assembly includes said flow passage extending therethrough.

17. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port axially aligned with said central longitudinal axis of said housing for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port;

wherein said actuator assembly comprises a plurality of collinear tubular members, each of said tubular members having a passage, said passages forming said fluid flow passage, a first of said tubular members comprises a first outwardly flared conical section extending radially outward from a cylindrical body section of said first of said tubular members, a second of said tubular members being adjacent to and aligned with said first of said tubular members and including a diameter reducing conical section disposed adjacent to and aligned with said cylindrical body section of said first of said tubular members; and wherein a spring support assembly is adjacent said outwardly flared conical section of said first of said tubular members.

18. The dry sprinkler assembly according to claim 17, wherein said spring support assembly is coupled to said first of said tubular members.

19. The dry sprinkler assembly according to claim 17, wherein said spring support assembly comprises a base, a plurality of arms, and a spring plate coupled to said base, said arms being coupled to said first of said tubular members.

20. The dry pipe sprinkler assembly according to claim 17, wherein said sealing subassembly is fixed to one of said plurality of collinear tubular members of said actuator assembly so as to be disposed along said central longitudinal axis both prior to and after said trigger assembly releases.

21. The dry pipe sprinkler assembly according to claim 20, wherein said sealing subassembly includes a spring plate and a spring plate support supporting said spring plate and having a projecting boss extending upstream of said spring plate.

22. The dry pipe sprinkler assembly according to claim 21, wherein said projecting boss includes a central tip disposed generally on said central axis and a tapered portion extending downstream from said central tip.

23. The dry pipe sprinkler assembly according to claim 22, wherein said tapered portion is conical.

24. The dry pipe sprinkler assembly according to claim 22, wherein said actuator assembly includes said flow passage extending therethrough.

25. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port axially aligned with said central longitudinal axis of said housing for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition;

an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port; and a spring, said spring urging said first of said tubular members into contact with said second of said tubular members; and wherein said actuator assembly comprises a plurality of collinear tubular members, each of said tubular members having a passage, said passages forming said fluid flow passage, a first of said tubular members comprises a first outwardly flared conical section extending radially outward from a cylindrical body section of said first of said tubular members, a second of said tubular members being adjacent to and aligned with said first of said tubular members and including a diameter reducing conical section disposed adjacent to and aligned with said cylindrical body section of said first of said tubular members.

26. The dry pipe sprinkler assembly according to claim 25, wherein said sealing subassembly is fixed to at least one of said plurality of collinear tubular members of said actuator assembly so as to be disposed along said central longitudinal axis both prior to and after said trigger assembly releases.

27. The dry pipe sprinkler assembly according to claim 26, wherein said sealing subassembly includes a spring plate and a spring plate support supporting said spring plate and having a projecting boss extending upstream of said spring plate.

28. The dry pipe sprinkler assembly according to claim 27, wherein said projecting boss includes a central tip disposed generally on said central axis and a tapered portion extending downstream from said central tip.

29. The dry pipe sprinkler assembly according to claim 28, wherein said tapered portion is conical.

30. The dry pipe sprinkler assembly according to claim 28, wherein said actuator assembly includes said flow passage extending therethrough.

31. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port;

wherein said actuator assembly comprises a plurality of collinear tubular members, each of said tubular members having a passage, said passages forming said fluid flow passage, a first of said tubular members comprises an outwardly flared conical section, a second of said tubular members being adjacent to and aligned with said first of said tubular members, wherein said second of said tubular members comprises a diameter reducing conical section, said first of said tubular members being adjacent and aligned with said conical section; and a spring urging said first of said tubular members into contact with said second of said tubular members.

32. The dry pipe sprinkler assembly according to claim 31, wherein said sealing subassembly is fixed to one of said plurality of collinear tubular members of said actuator assembly so as to be disposed along said central longitudinal axis both prior to and after said trigger assembly releases.

33. The dry pipe sprinkler assembly according to claim 32, wherein said sealing subassembly includes a spring plate and a spring plate support supporting said spring plate and having a projecting boss extending upstream of said spring plate.

34. The dry pipe sprinkler assembly according to claim 33, wherein said projecting boss includes a central tip disposed generally on said central axis and a tapered portion extending downstream from said central tip.

35. The dry pipe sprinkler assembly according to claim 34, wherein said tapered portion is conical.

36. The dry pipe sprinkler assembly according to claim 34, wherein said actuator assembly includes said flow passage extending therethrough.

37. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port axially aligned with said central longitudinal axis of said housing for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition;

an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port; and wherein said actuator assembly comprises a plurality of collinear tubular members, each of said tubular members having a passage, said passages forming said fluid flow passage, a first of said tubular members comprises a first outwardly flared conical section extending radially outward from a cylindrical body section of said first of said tubular members, a second of said tubular members being adjacent to and aligned with said first of said tubular members and including a diameter reducing conical section disposed adjacent to and aligned with said cylindrical body section of said first of said tubular members, a third of said tubular members being adjacent to said second of said tubular members.

38. The dry pipe sprinkler assembly according to claim 37, wherein said sealing subassembly is fixed to one of said plurality of collinear tubular members of said actuator assembly so as to be disposed along said central longitudinal axis both prior to and after said trigger assembly releases.

39. The dry pipe sprinkler assembly according to claim 38, wherein said sealing subassembly includes a spring plate and a spring plate support supporting said spring plate and having a projecting boss extending upstream of said spring plate.

40. The dry pipe sprinkler assembly according to claim 39, wherein said projecting boss includes a central tip disposed generally on said central axis and a tapered portion extending downstream from said central tip.

41. The dry pipe sprinkler assembly according to claim 40, wherein said tapered portion is conical.

42. The dry pipe sprinkler assembly according to claim 40, wherein said actuator assembly includes said flow passage extending therethrough.

43. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port;

wherein said actuator assembly comprises a plurality of collinear tubular members, each of said tubular members having a passage, said passages forming said fluid flow passage, a first of said tubular members comprises an outwardly flared conical section, a second of said tubular members being adjacent to and aligned with said first of said tubular members, wherein said second of said tubular members comprises a diameter reducing conical section, said first of said tubular members being adjacent and aligned with said conical section; and wherein a third of said tubular members is adjacent said second of said tubular members, wherein said third of said tubular members contacts said trigger assembly.

44. The dry pipe sprinkler assembly according to claim 43, wherein said sealing subassembly is fixed to said first of said tubular members of said actuator assembly so as to be disposed along said central longitudinal axis both prior to and after said trigger assembly releases.

45. The dry pipe sprinkler assembly according to claim 44, wherein said sealing subassembly includes a spring plate and a spring plate support supporting said spring plate and having a projecting boss extending upstream of said spring plate.

46. The dry pipe sprinkler assembly according to claim 45, wherein said projecting boss includes a central tip disposed generally on said central axis and a tapered portion extending downstream from said central tip.

47. The dry pipe sprinkler assembly according to claim 46, wherein said tapered portion is conical.

48. The dry pipe sprinkler assembly according to claim 46, wherein said actuator assembly includes said flow passage extending therethrough.

49. A dry sprinkler assembly comprising:

a housing having an inlet end, an outlet end, and a central longitudinal axis, and said inlet end being adapted for mounting to a fluid supply pipe and having an inlet port for fluid communication with the fluid supply pipe;

a sprinkler head assembly having a sprinkler head and a trigger assembly;

an actuator assembly, said actuator assembly having a fluid flow passage extending from said inlet end to said outlet end and sealing said inlet port;

said sprinkler head being in fluid communication with said fluid flow passage and having an outlet opening;

said trigger assembly substantially closing said outlet opening and releasing said closure when a fire condition is present; and said actuator assembly being operatively coupled to said trigger assembly such that said actuator assembly releases said sealing of said inlet port in response to said trigger assembly releasing said closure at said outlet opening, and said actuator assembly moving in a linear path substantially parallel with said central longitudinal axis when releasing said sealing of said inlet port; and wherein said actuator assembly comprises a sealing subassembly, said sealing subassembly comprising a spring plate, said spring plate being axially compressed against an axial end surface of said inlet end surrounding said inlet port, said axial end surface being perpendicular to said central longitudinal axis, wherein said spring plate is fixed to said fluid flow passage of said actuator assembly so as to be disposed along said central longitudinal axis of said housing after said trigger assembly releases and said actuator assembly moves along an entirety of said linear path, so that water flowing through said housing flows around said spring plate fixed to said fluid flow passage.

50. The dry sprinkler assembly according to claim 49, wherein said sealing subassembly further comprises a spring plate support, said spring plate support supporting said spring plate.

51. The dry sprinkler assembly according to claim 50, wherein said spring plate and said spring plate support comprises a unitary assembly.

52. The dry sprinkler assembly according to claim 51, wherein said spring plate support comprises a base and a plurality of arms defining therebetween a plurality of passages, said passages forming a portion of said fluid flow passage.

53. The dry sprinkler assembly according to claim 52, wherein said actuator assembly comprises a plurality of collinear members, each of said members having a passage, said passages being in communication and forming another portion of said fluid flow passage.

54. The dry sprinkler assembly according to claim 53, wherein said plurality of members include a tubular member, said arms of said spring plate support coupled to said tubular member wherein said spring plate support and said tubular member move together along said central longitudinal axis.

55. The dry sprinkler assembly according to claim 52, wherein said spring plate is coupled to said base.

56. A dry sprinkler assembly comprising:

a housing having an inlet end, an outlet end, and a central longitudinal axis, and said inlet end being adapted for mounting to a fluid supply pipe and having an inlet port for fluid communication with the fluid supply pipe;

a sprinkler head assembly having a sprinkler head and a trigger assembly;

an actuator assembly, said actuator assembly having a fluid flow passage extending from said inlet end to said outlet end and sealing said inlet port;

said sprinkler head being in fluid communication with said fluid flow passage and having an outlet opening;

said trigger assembly substantially closing said outlet opening and releasing said closure when a fire condition is present;

said actuator assembly being operatively coupled to said trigger assembly such that said actuator assembly releases said sealing of said inlet port in response to said trigger assembly releasing said closure at said outlet opening, and said actuator assembly moving in a linear path substantially parallel with said central longitudinal axis when releasing said sealing of said inlet port;

wherein said actuator assembly comprises a sealing subassembly, said sealing subassembly comprising a spring plate, said spring plate being axially compressed against an axial end surface of said inlet end surrounding said inlet port, said axial end surface being perpendicular to said central longitudinal axis;

wherein said sealing subassembly further comprises a spring plate support, said spring plate support supporting said spring plate;

wherein said spring plate and said spring plate support comprises a unitary assembly;

wherein said spring plate support comprises a base and a plurality of arms defining therebetween a plurality of passages, said passages forming a portion of said fluid flow passage;

wherein said actuator assembly comprises a plurality of collinear members, each of said members having a passage, said passages being in communication and forming another portion of said fluid flow passage;

wherein said plurality of members include a tubular member, said arms of said spring plate support coupled to said tubular member wherein said spring plate support and said tubular member move together along said central longitudinal axis;

further comprising a spring, said spring urging said tubular member toward said trigger assembly.

57. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port and remaining fixed in said housing after said trigger assembly releases during a fire condition; and wherein said sealing subassembly comprises a spring plate support including a base and a plurality of arms fixedly attached to said base, said base of said spring plate support supporting a spring plate, said spring plate being axially compressed against an axial end surface of said inlet end surrounding said inlet port, said axial end surface being perpendicular to said central longitudinal axis.

58. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port wherein the flow of fire suppressant through said inlet port and into said fluid flow passage is substantially unimpeded; and wherein said sealing subassembly comprises:

a plate and a plate support, said plate support supporting said plate, and said plate sealing said inlet port;

a first member attached to said plate support at a first end;

a tubular second member adjacent to a second end of said first member, said tubular second member including a diameter reducing conical section; and a tubular seat member adjacent to said tubular second member and disposed in said outlet opening of said sprinkler head assembly.

59. The dry pipe sprinkler assembly according to claim 58, wherein said first member is biased toward said tubular second member.

60. The dry pipe sprinkler assembly according to claim 58, wherein said tubular seat member includes two semi-cylindrical sections.

61. The dry pipe sprinkler assembly according to claim 58, wherein said plate support is fixed to said first member of said actuator assembly so as to be disposed along said central longitudinal axis both prior to and after said trigger assembly releases.

62. The dry pipe sprinkler assembly according to claim 61, wherein said plate support includes a projecting boss extending upstream of said plate.

63. The dry pipe sprinkler assembly according to claim 62, wherein said projecting boss includes a central tip disposed generally on said central axis and a tapered portion extending downstream from said central tip.

64. The dry pipe sprinkler assembly according to claim 63, wherein said tapered portion is conical.

65. The dry pipe sprinkler assembly according to claim 63, wherein said actuator assembly includes said flow passage extending therethrough.

66. A sprinkler, comprising:

a sprinkler body;

a thermally responsive element mounted to said sprinkler body;

a housing including an inlet end and an outlet end, said outlet end being connected to said sprinkler body;

a seal member disposed at said inlet end of said housing; and an actuator assembly extending between said thermally responsive element and said seal member, wherein said actuator assembly includes a support base staked to said seal member and a flow passageway tube portion engaging said support base, and wherein said support base and said flow passageway tube portion are slidable relative to said housing and said support base includes at least three spaced legs engaging said flow passageway tube portion.

67. The sprinkler according to claim 66, wherein said at least three spaced legs extend radially outward from a central body of said support base.

68. The sprinkler according to claim 66, wherein said at least three spaced legs are received in said flow passageway tube portion.

69. The sprinkler according to claim 67, wherein said central body of said support base supports said seal member.

70. The sprinkler according to claim 67, wherein said central body of said support base is coaxial with a central axis of said flow passageway tube portion.

71. The dry pipe sprinkler assembly according to claim 66, wherein said support base is fixed to said flow passageway tube portion of said actuator assembly so as to be disposed along said central longitudinal axis both prior to and after said trigger assembly releases.

72. The dry pipe sprinkler assembly according to claim 71, wherein said support base is fixed to a spring base that is fixed to said seal member and includes a projecting boss extending upstream of said seal member.

73. The dry pipe sprinkler assembly according to claim 72, wherein said projecting boss includes a central tip disposed generally on said central axis and a tapered portion extending downstream from said central tip.

74. The dry pipe sprinkler assembly according to claim 73, wherein said tapered portion is conical.

75. The dry pipe sprinkler assembly according to claim 73, wherein said actuator assembly includes said flow passage extending therethrough.

76. A sprinkler, comprising:

a sprinkler body;

a thermally responsive element mounted to said sprinkler body;

a housing including an inlet end and an outlet end, said outlet end being connected to said sprinkler body;

a seal member disposed at said inlet end of said housing; and an actuator assembly extending between said thermally responsive element and said seal member, wherein said actuator assembly includes a support base fixedly attached to said seal member and a flow passageway tube portion engaging said support base, wherein said flow passageway tube portion has a conical portion extending radially outward toward said housing and adjacent to said support base and wherein said support base and said flow passageway tube portion are fixed together and slidable relative to said housing, wherein said support base is fixed to said flow passageway tube portion of said actuator assembly so as to fixedly support said seal member generally centered along said central longitudinal axis both prior to and after said trigger assembly releases so that said seal member remains fixed along said central longitudinal axis after said seal member is moved away from said inlet end of said housing.

77. A dry sprinkler assembly comprising:

a housing having an inlet end, an outlet end, and a central longitudinal axis, and said inlet end being adapted for mounting to a fluid supply pipe and having an inlet port for fluid communication with the fluid supply pipe;

a sprinkler head assembly having a sprinkler head and a trigger assembly;

an actuator assembly, said actuator assembly having a fluid flow passage extending from said inlet end to said outlet end and sealing said inlet port;

said sprinkler head being in fluid communication with said fluid flow passage and having an outlet opening;

said trigger assembly substantially closing said outlet opening and releasing said closure when a fire condition is present; and said actuator assembly being operatively coupled to said trigger assembly such that said actuator assembly releases said sealing of said inlet port in response to said trigger assembly releasing said closure at said outlet opening, and said actuator assembly moving in a linear path substantially parallel with said central longitudinal axis when releasing said sealing of said inlet port; and wherein said actuator assembly comprises a sealing subassembly, said sealing subassembly comprising a spring plate, said spring plate being axially compressed against an axial end surface of said inlet end surrounding said inlet port, said axial end surface being perpendicular to said central longitudinal axis; and wherein said sealing subassembly includes a projecting boss extending upstream of said spring plate.

78. The dry pipe sprinkler assembly according to claim 77, wherein said projecting boss includes a central tip disposed generally on said central axis and a tapered portion extending downstream from said central tip.

79. The dry pipe sprinkler assembly according to claim 78, wherein said tapered portion is conical.

80. The dry pipe sprinkler assembly according to claim 78, wherein said actuator assembly includes said flow passage extending therethrough.

81. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head being in fluid communication with said fluid flow passage and having an outlet opening, and said trigger assembly substantially closing said outlet opening and releasing said closure during a fire condition; and an actuator assembly, said actuator assembly having a sealing subassembly sealing said inlet port, said actuator assembly being operatively coupled to said trigger assembly such that said sealing subassembly releases said sealing of said inlet port in response to said trigger assembly releasing said closure at said outlet opening, and said sealing subassembly moving in a linear path substantially parallel with said central longitudinal axis when releasing said sealing of said inlet port; and wherein said sealing subassembly comprises a spring plate support including a base and a plurality of arms, said base of said spring plate support supporting a spring plate, said spring plate being axially compressed against an axial end surface of said inlet end surrounding said inlet port, said axial end surface being perpendicular to said central longitudinal axis; and wherein said spring plate support includes a projecting boss extending upstream of said spring plate.

82. The dry pipe sprinkler assembly according to claim 81, wherein said projecting boss includes a central tip disposed generally on said central axis and a tapered portion extending downstream from said central tip.

83. The dry pipe sprinkler assembly according to claim 82, wherein said tapered portion is conical.

84. The dry pipe sprinkler assembly according to claim 82, wherein said actuator assembly includes said flow passage extending therethrough.

85. A sprinkler, comprising:

a sprinkler body;

a thermally responsive element mounted to said sprinkler body;

a housing including an inlet end and an outlet end, said outlet end being connected to said sprinkler body;

a seal member disposed at said inlet end of said housing; and an actuator assembly extending between said thermally responsive element and said seal member, wherein said actuator assembly includes a support base fixedly attached to said seal member and a flow passageway tube portion engaging said support base, wherein said flow passageway tube portion has a conical portion extending radially outward toward said housing and adjacent to said support base and wherein said support base and said flow passageway tube portion are fixed together and slidable relative to said housing, wherein said support base is fixed to said flow passageway tube portion of said actuator assembly so as to fixedly support said seal member generally centered along said central longitudinal axis both prior to and after said trigger assembly releases, wherein said support base includes a projecting boss extending upstream of said seal member.

86. The dry pipe sprinkler assembly according to claim 85, wherein said projecting boss includes a central tip disposed generally on said central axis and a tapered portion extending downstream from said central tip.

87. The dry pipe sprinkler assembly according to claim 86, wherein said tapered portion is conical.

88. The dry pipe sprinkler assembly according to claim 86, wherein said actuator assembly includes said flow passage extending therethrough.

89. A dry sprinkler assembly comprising:

a housing having an inlet end, an outlet end, a fluid flow passage extending from said inlet end to said outlet end, and a central longitudinal axis along said fluid flow passage, and said inlet end being adapted for mounting to a fluid supply pipe and having an inlet port for fluid communication with the fluid supply pipe;

a sprinkler head assembly having a sprinkler head and a trigger assembly, said sprinkler head including a body and a frame including two spaced arms integrally formed with and extending from said body, said body being mounted to said outlet end of said housing in fluid communication with said fluid flow passage and having an outlet opening, and said trigger assembly supported at said outlet opening by said two spaced arms of said frame and being activated to be released during a fire condition; and an actuator assembly, said actuator assembly having a sealing subassembly sealing said inlet port of said housing, said actuator assembly being operatively coupled to said trigger assembly such that said sealing subassembly releases said sealing of said inlet port in response to said trigger assembly being released from said outlet opening, and said sealing subassembly moving in a linear path substantially parallel with said central longitudinal axis when releasing said sealing of said inlet port; and wherein said sealing subassembly comprises a concave spring plate having a concave surface facing said inlet port and a spring plate support, said spring plate support being fixedly secured to said spring plate and compressively loading said spring plate axially against a surface of said inlet end surrounding said inlet port so as to flatten said spring plate toward a generally planar orientation when assembled, said spring plate support and said spring plate being fixed for linear movement along said central longitudinal axis so as to be disposed within said housing along said central longitudinal axis both prior to and after said trigger assembly releases.

90. The dry sprinkler assembly according to claim 89, wherein said spring plate support includes a projecting boss extending upstream of said spring plate.

91. The dry sprinkler assembly according to claim 90, wherein said projecting boss includes a central tip disposed generally on said central axis and a tapered portion extending downstream from said central tip.

92. The dry sprinkler assembly according to claim 91, wherein said tapered portion is conical.

93. The dry sprinkler assembly according to claim 92, wherein said actuator assembly includes said flow passage extending therethrough.

94. The sprinkler assembly according to claim 89, wherein said spring plate support includes a spring base fixedly mounted to a support base, said spring plate being fixedly mounted to said spring base and said support base being fixedly mounted to a tubular member of said actuator assembly.

* * * * *

UNITED STATES PATENT AND TRADEMARK OFFICE

CERTIFICATE OF CORRECTION

PATENT NO. : 8,636,075 B2
APPLICATION NO. : 11/054476
DATED : January 28, 2014
INVENTOR(S) : Franson et al.

It is certified that error appears in the above-identified patent and that said Letters Patent is hereby corrected as shown below:

In the Specification

At column 5, line number 26, delete “member” and insert --housing-- therefor.

At column 6, line number 11, after “inlet”, insert --member-- therefor.

At column 6, line number 15, after “between”, insert --spring-- therefor.

At column 6, line number 36, delete “Base” and insert --Spring base-- therefor.

At column 7, line number 16, delete “48” and insert --31-- therefor.

In the Claims

At column 9, line number 19, In Claim 9, delete “claim 1,” and insert --claim 8-- therefor.

Signed and Sealed this
Seventh Day of October, 2014

Michelle K. Lee

Michelle K. Lee
*Deputy Director of the United States Patent and Trademark Office*